US010249413B2

(12) United States Patent
Huber et al.

(10) Patent No.: US 10,249,413 B2
(45) Date of Patent: Apr. 2, 2019

(54) SHIELDED ELECTRICAL CABLE

(71) Applicant: MD ELEKTRONIK GmbH, Waldkraiburg (DE)

(72) Inventors: Martin Huber, Obing (DE); Johannes Trae, Muehldorf a. Inn (DE)

(73) Assignee: MD ELEKTRONIK GMBH, Waldkraiburg (DE)

( * ) Notice: Subject to any disclaimer, the term of this patent is extended or adjusted under 35 U.S.C. 154(b) by 7 days.

(21) Appl. No.: 15/618,142

(22) Filed: Jun. 9, 2017

(65) Prior Publication Data

US 2018/0005730 A1 Jan. 4, 2018

(30) Foreign Application Priority Data

Jun. 30, 2016 (EP) ..... 16177196

(51) Int. Cl.

| | |
|---|---|
| ***H01B 11/18*** | (2006.01) |
| ***H01B 11/02*** | (2006.01) |
| ***H01B 13/24*** | (2006.01) |
| *H01R 12/53* | (2011.01) |
| *H01B 7/00* | (2006.01) |

(52) U.S. Cl.

CPC ..... *H01B 11/1895* (2013.01); *H01B 11/02* (2013.01); *H01B 13/24* (2013.01); *H01B 7/009* (2013.01); *H01R 12/53* (2013.01)

(58) Field of Classification Search

CPC .... H01B 11/1895; H01B 11/02; H01B 13/24; H01B 7/009; H01B 12/53; H01R 12/51; H01R 12/59

USPC ..... 174/102 R, 113 R, 117 R, 117 F, 117 FF, 174/74 R, 78, 84 R, 88 R; 439/497, 604, 439/79, 76.1

See application file for complete search history.

(56) References Cited

U.S. PATENT DOCUMENTS

| | | | | |
|---|---|---|---|---|
| 3,691,509 | A * | 9/1972 | Krol | H01R 12/775 439/422 |
| 3,703,604 | A * | 11/1972 | Henschen | H01B 7/0838 174/117 FF |
| 4,328,487 | A * | 5/1982 | Cheal | G08B 13/2497 333/237 |
| 4,768,287 | A * | 9/1988 | Thies | H01R 12/675 29/861 |
| 5,798,486 | A * | 8/1998 | Elsinger | H01R 12/62 174/117 F |
| 6,247,977 | B1 * | 6/2001 | Tanaka | B60R 16/027 439/492 |
| 8,011,950 | B2 * | 9/2011 | McGrath | H01R 12/594 439/497 |

(Continued)

*Primary Examiner* — William H Mayo, III

(74) *Attorney, Agent, or Firm* — Leydig, Voit & Mayer, Ltd.

(57) ABSTRACT

A shielded electrical cable includes at least two spaced-apart conductors extending side-by-side along a longitudinal cable direction. An insulation electrically insulates the conductors from each other. A cable shield, together with the conductors, extends along the longitudinal cable direction and annularly surrounds the conductors, as seen in cross section. An electrical device is disposed between the conductors and the cable shield. The electrical device is surrounded by the cable shield and disposed on the conductors such that the electrical device is in electrical contact with each of the conductors.

17 Claims, 5 Drawing Sheets

(56) References Cited

U.S. PATENT DOCUMENTS

| | | | | |
|---|---|---|---|---|
| 8,388,182 | B2 * | 3/2013 | Chang | F21V 19/0015 362/249.02 |
| 8,736,527 | B2 * | 5/2014 | Verlinden | H05B 33/0806 174/68.1 |
| 2003/0168247 | A1 * | 9/2003 | Schreck | B60Q 1/2607 174/126.4 |
| 2005/0092517 | A1 | 5/2005 | Fan | |
| 2005/0180162 | A1 * | 8/2005 | Fan | F21S 4/24 362/555 |
| 2009/0101408 | A1 * | 4/2009 | Koyama | H01R 9/0506 174/72 A |
| 2011/0028038 | A1 * | 2/2011 | Luo | H01R 12/62 439/607.58 |
| 2011/0061933 | A1 * | 3/2011 | Prest | H01R 31/06 174/75 R |
| 2013/0075149 | A1 * | 3/2013 | Golko | H01R 13/516 174/359 |
| 2014/0016901 | A1 * | 1/2014 | Lambourn | G02B 6/3895 385/75 |
| 2016/0142030 | A1 | 5/2016 | Hamner et al. | |

* cited by examiner

A-A

SHIELDED ELECTRICAL CABLE

CROSS-REFERENCE TO PRIOR APPLICATION

Priority is claimed to European Patent Application No. EP 16177196.9, filed on Jun. 30, 2016, the entire disclosure of which is hereby incorporated by reference herein.

FIELD

The present invention relates to a shielded electrical cable, in particular in the form of a cable for data transmission in motor vehicles.

BACKGROUND

Such a cable, which is typically configured to extend longitudinally, includes at least two electrical conductors which extend side-by-side (e.g., parallel to each other or in twisted form) along the longitudinal cable direction and whose electrically conductive components (stranded wires) are spaced apart in a direction transverse to the longitudinal cable direction. The cable further includes at least one insulating member, for example, in the form of an electrically insulating layer, which insulates the conductors from each other, as well as a cable shield which serves to electrically shield the cable and which, together with the conductors, extends along the longitudinal cable direction and annularly surrounds the same, as seen in cross section. This is a typical design of a cable having multiple (at least two) conductors and a cable shield.

SUMMARY

In an embodiment, the present invention provides a shielded electrical cable including at least two spaced-apart conductors extending side-by-side along a longitudinal cable direction. An insulation electrically insulates the conductors from each other. A cable shield, together with the conductors, extends along the longitudinal cable direction and annularly surrounds the conductors, as seen in cross section. At least one electrical device is disposed between the conductors and the cable shield. The at least one electrical device is surrounded by the cable shield and disposed on the conductors such that the at least one electrical device is in electrical contact with each of the conductors.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1A:
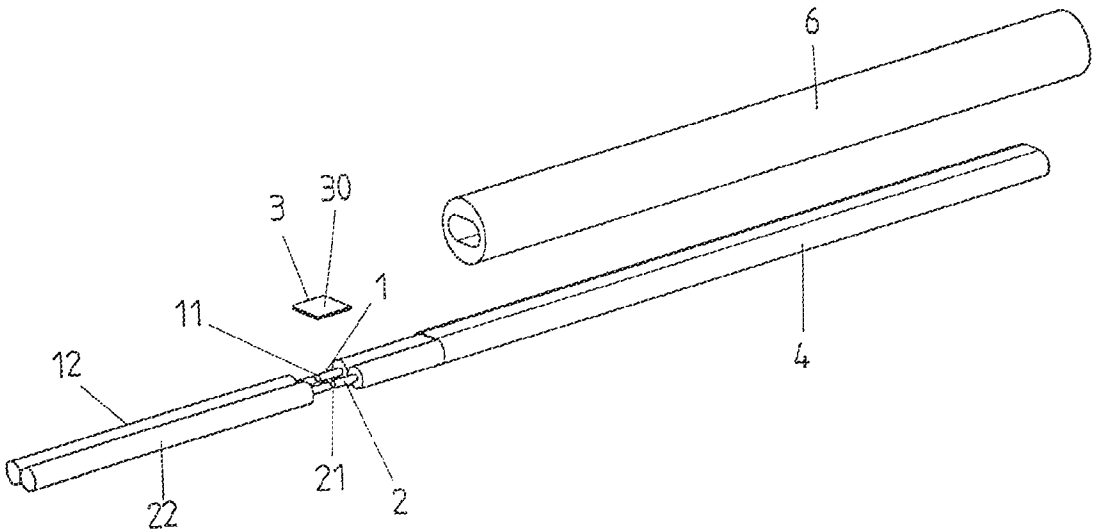
FIG. 1*a* shows an exploded view of a two-conductor electrical cable having an electrical device integrated therein.
Figure 1C:
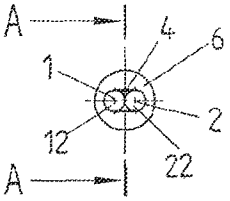
FIG. 1*c* shows a cross section through the cable of FIG. 1*a;*

In an embodiment, the present invention enhances the functionality of a shielded electrical cable.

According to an embodiment, provision is further made for an electrical device to be disposed between the conductors and the cable shield, the electrical device being surrounded by the cable shield and placed (laid) on each of the two spaced-apart conductors such that it is in electrical contact with each of the conductors.

The electrical device may be an active electrical device, such as an active radio-frequency identification (RFID) element, an integrated circuit, such as an application-specific integrated circuit (ASIC) or an application-specific standard product (ASSP), or a passive electrical device, such as a passive RFID element. This term includes electronic devices, in particular semiconductive devices, which may be in the form of bare dies.

If the electrical device is suitable for transmitting signals via radio waves, as in the case of RFID elements, it is advantageous to perform the signal transmission in a frequency range below 15 MHz, in particular below 150 kHz.

What is important according to an embodiment is that the electrical device is integrated into the electrical cable in such a way that the electrical device is placed (for example, with a carrier body thereof, such as a circuit board) on two spaced-apart conductors of the cable; i.e., in particular, that it rests thereagainst (and is thus at the same time in electrical contact therewith). Therefore, this is in contrast to configurations where an electrical device is disposed at a substantial distance from the conductors of the cable and electrically connected thereto by additional wires, as described, for example, in US 2005/0092517 A1.

With the approach of an embodiment of the present invention, electrical devices which heretofore have been integrated, for example, into a connector attached to a cable (at an end thereof) can now be disposed and received in a region of the cable outside the connector. This means that the electrical device is deliberately disposed outside a region of the electrical cable which is provided with electrical connector elements for making an electrical connection with a mating electrical connector.

In the case of an electrical cable that is already provided with a connector/connectors at the end(s) thereof, this means that the respective device is disposed outside of the connector, in particular outside of a (respective) housing of the connector. In the case of an electrical cable not (yet) been provided with a connector/connectors, this means that the electrical device is disposed in a region of the cable which is not adapted (configured and designed) to be disposed in the housing of a connector.

For purposes of electrically contacting the conductors of the cable on which the electrical device is placed, the electrical device may have electrical connecting elements which extend from the carrier body thereof and via which the electrical device rests against the conductors of the cable. The connecting elements may be in the form of, for example, rigid electrical connection points via which the carrier body of the electrical device rests against the respective conductors in a fixed position relative thereto.

The fixed attachment of the electrical device to a respective conductor of the cable may in particular be accomplished by a material-to-material bond, for example, by fixing the electrical device via the electrical connecting elements (connection points) formed on its carrier body to the respective conductors of the cable by a material-to-material bond. The material-to-material bond may be created by soldering, welding or using an electrically conductive adhesive. Accordingly, the formation of the material-to-material bond may cause melting of the surface of the electrical connecting elements/connection points.

At the location on the cable where the electrical device is to be mounted, the at least one insulating member of the cable, which surrounds the conductors thereof and thereby electrically insulates the same from each other, is partially removed to provide a free space for receiving the electrical device. The partial removal of the insulating member may be accomplished thermally or mechanically, for example, by planar and/or contour-controlled and/or circumferential removal of the insulating member.

Furthermore, at the location where the electrical device is disposed, the conductors of the cable, together with the electrical device, may be surrounded by a protective layer which is produced separately from the insulating member, for example, by overmolding, potting and/or adhesively. This additional measure may be omitted if there is no need to protect the cable in this manner at the location that is partially stripped and provided with an electrical device.

According to an embodiment of a method for manufacturing the cable, the shield of the cable, which surrounds the conductors of the cable as well as the (at least one) electrical device disposed thereon, is applied externally to the cable only after the respective electrical device has been fixed to the conductors of the cable at the intended location and electrically contacted thereto.

FIGS. 1*a* through 1*d* show a two-conductor shielded electrical cable whose conductors 1, 2 are composed of an electrically conductive material. The two conductors 1, 2 of the cable extend side-by-side along a longitudinal cable direction L and are spaced apart in a direction transverse to longitudinal cable direction L. In the exemplary embodiment presented here, the two conductors 1, 2 extend substantially parallel to each other, but alternatively they may be twisted together.

The cable is generally flexible, so that longitudinal cable direction L does not necessarily have to be straight, as shown in the figures. Rather, longitudinal cable direction L may also follow a (possibly multiply) curved path of the cable. The two conductors 1, 2 of the cable are electrically insulated from each other. To this end, in the exemplary embodiment, each of the two conductors 1, 2 is surrounded by an electrically insulating member (insulation 12 or 22, respectively), in particular in the form of an insulating layer.

In a section, the two conductors 1, 2 are freed from insulation 12, 22, at least partially or all around (along their circumference), as in the exemplary embodiment of FIGS. 1*a* through 1*d*. In each section, an electrical device 3 is placed on conductors 1, 2.

In the exemplary embodiment presented here, the device may be an RFID element, which may take the form of an active or passive electrical device. The term "electrical device," as used herein, explicitly includes electronic devices and, in particular, also semiconductive devices.

Electrical device 3 is placed on the two conductors 1, 2 of the cable such that an electrical connection is established with both conductors 1, 2. To this end, as will be explained below in more detail with reference to FIG. 2*b*, electrical device 3 may have electrical connecting elements via which electrical device 3 is placed on conductors 1, 2 so that (via these connecting elements) it rests against the conductors 1, 2 on the one hand, and is electrically connected to conductors 1, 2 on the other hand.

In the exemplary embodiment, carrier body 30 of electrical device 3 takes the form of a circuit board, on which are positioned the components of the electrical device, such as, for example, semiconductive or other electronic devices. The components of electrical device 3 can be connected to conductors 1, 2 via the already mentioned connecting elements.

As a result, the two conductors 1, 2 are electrically coupled to each other via electrical device 3. In addition, at least one of the two conductors 1, 2 may have a discontinuity 11 or 21, respectively, in the region where electrical device 3 is disposed, the discontinuity being bridged by electrical device 3. In this case, electrical device 3 (also) serves to couple two sections of the respective conductor 1, 2 on both sides of discontinuity 11 or 21, respectively.

Because electrical device 3 rests against the two conductors 1, 2 via (rigid) electrical connecting elements, for example, in the form of electrical connection points slightly projecting from carrier body 30 of electrical device 3, it is at the same time ensured that electrical device 3 can be securely located in position on conductors 1, 2.

Conductors 1, 2 and associated insulations 12, 22 as well as electrical device 3 are surrounded by a cable shield 4, which is made from an electrically conductive material and serves to electrically shield the cable. Cable shield 4, together with conductors 1, 2, extends along longitudinal cable direction L, so that conductors 1, 2 are annularly surrounded by cable shield 4, as seen in cross section. The same applies to electrical device 3. (In FIG. 1*a*, cable shield 4 is shown only in the right portion of the cable so as to make visible conductors 1, 2, their insulations 12, 22 and the electrical device in the left portion of the cable.

Instead of a single electrical device 3, multiple electrical devices may be placed on conductors 1, 2 of the cable along longitudinal cable direction L in spaced-apart relationship to one another.

The fixed attachment of electrical device 3 to conductors 1, 2 via the associated electrical connecting elements may in particular be accomplished by a material-to-material bond, for example, by welding, soldering or using an electrically conductive adhesive. Accordingly, the formation of the material-to-material bond may cause melting of the surface of the electrical connecting elements.

Figure 1B:
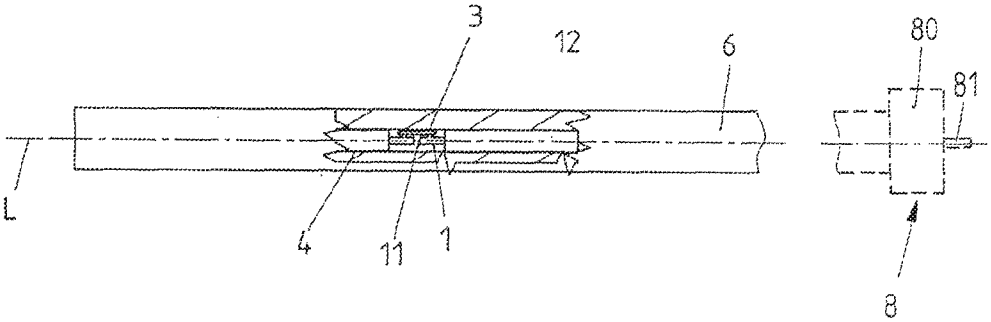
FIG. 1*b* shows a partially broken away side view of the cable of FIG. 1*a;*
Figure 1D:
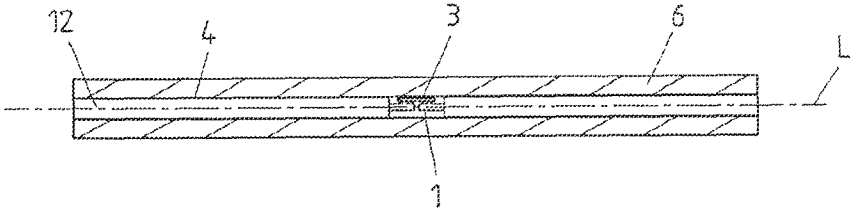
FIG. 1*d* shows a longitudinal section through the cable of FIG. 1*a;*

The local stripping of insulation from conductors 1, 2 to enable electrical contact with electrical device 3 may be performed in particular mechanically or thermally, in the latter case using, for example, laser radiation. In this connection, provision may be made for the stripping to be performed by planar removal of insulations 12, 22, contour-controlled removal of insulations 12, 22 or circumferential removal of insulations 12, 22, as shown in FIGS. 1*a* and 1*b*.

Figure 2A:
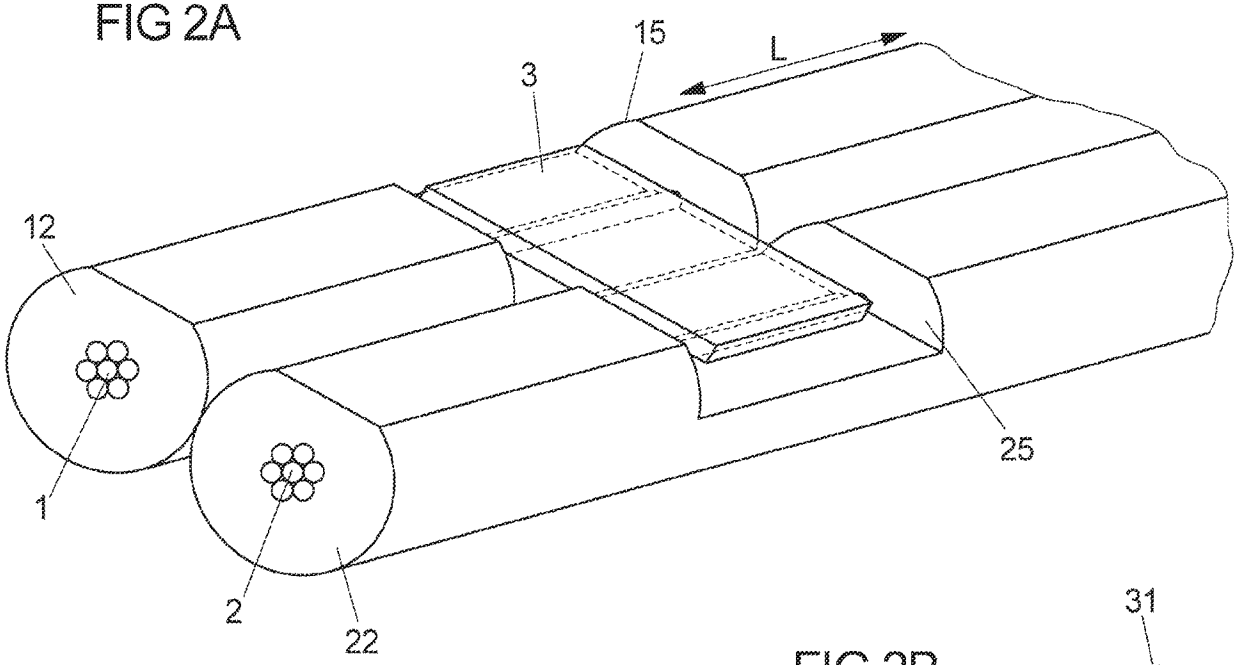
FIG. 2*a* shows a first step during the manufacture of an electrical cable according to FIG. 1*a* in a modified embodiment.
Figure 2B:
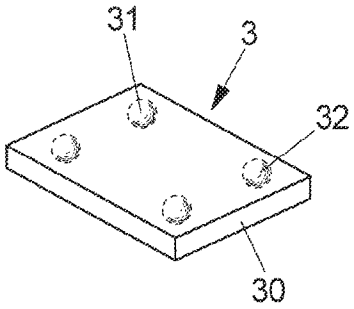
FIG. 2*b* shows a detail view of an electrical device integrated into the cable shown in FIG. 2*a;*
Figure 2C:
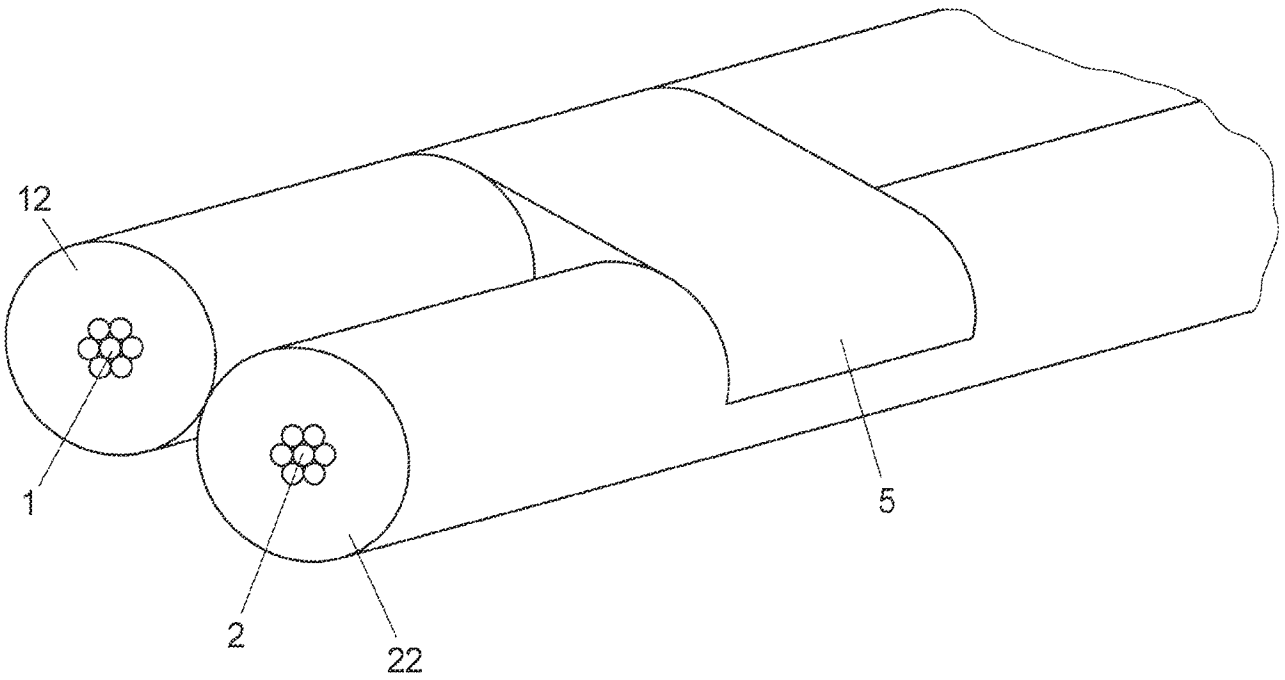
FIG. 2*c* shows a second step during the manufacture of the cable, based on FIG. 2*a*.

Depending on the intended use of the cable, the (partially) stripped region where electrical device 3 is disposed may be provided with a protective layer, which may be produced, for example, by overmolding or potting, as shown in FIG. 2*c*, which will be described in greater detail hereinbelow.

It is also of importance here that electrical device 3 rests against conductors 1, 2 in a cable region which is free of electrical connector elements via which electrical contact would be made to a mating connector. This means that electrical device 3 is directly integrated into the electrical cable itself. It is not intended to be part of an electrical connector, and particularly not to be disposed in the housing of a connector. For purposes of illustration, FIG. 1*b* shows, in phantom, a connector 8 including a housing 80 and electrical connector elements 81 at one axial end of the cable, via which the electrical cable can be brought into electrical contact with a mating connector. Electrical device 3 which, according to FIGS. 1*a* through 1*d* is integrated into the cable in such a way that it rests against the conductors 1, 2 thereof, is thus disposed outside of connector 8, and particularly outside of connector housing 80.

Electrical device 3 is located on the electrical cable within the space surrounded by cable shield 4. The cable, including cable shield 4, may additionally be surrounded a cable jacket 6.

FIGS. 2*a* through 2*d* show different steps in the manufacture of a cable of the type shown in FIGS. 1*a* through 1*d*, the individual stranded wires of the conductors 1, 2 of the cable being also visible in FIGS. 2*a* through 2*d*. This specific embodiment differs from the electrical cable of FIGS. 1*a* through 1*d* as specified below. Firstly, as shown in FIGS. 2*a* through 2*d*, no discontinuity is provided in conductors 1, 2 at the location where electrical device 3 is placed on conductors 1, 2. Furthermore, as shown in FIGS. 2*a* through 2*d*, to permit mounting of electrical device 3 on conductors 1, 2, the associated insulation 12, 22 is removed on one side only of the conductors, and not circumferentially, as in the case of FIGS. 1*a* through 1*d*. Moreover, in contrast to the embodiment of FIGS. 1*a* through 1*d*, in the case FIG. 2, provision is made to apply an additional protective layer 5 at the location where the cable is partially freed from insulation 12, 22 and against which the electrical device 3 rests, the additional protective layer covering electrical device 3 and the stripped regions of conductors 1, 2. This additional protective layer may be, for example, an overmold.

FIG. 2*a* shows two conductors 1, 2 of an electrical cable, which extend side-by-side along a longitudinal cable direction L and are spaced apart in a direction transverse to longitudinal cable direction L, and which are each surrounded by an insulation 12 or 22, respectively. In a first step, the two conductors 1, 2 have been partially freed from the respective insulation 12, 22 to create a receiving region 10, 20 for an electrical device 3, which is placed on conductors 1, 2 and rests thereagainst.

As can be seen in the detail view of electrical device 3 in FIG. 2*b*, the electrical device has electrical connecting elements 31, 32 in the form of (rigid) electrical connection points for making electrical contact with conductors 1, 2, the electrical connecting elements slightly projecting from electrical device 3 or, more specifically, from its carrier body 30 in this exemplary embodiment. Here, carrier body 30 takes the form of a circuit board. Carrier body 30 has disposed thereon the electrical and/or electronic components of device 3. These components of the electrical device are electrically connectable and fixedly attachable to conductors 1, 2 of the cable via electrical connecting elements 31, 32.

The fixed attachment of electrical device 3 to conductors 1, 2 via the electrical connecting elements 31, 32 may in particular be accomplished by a material-to-material bond, for example, by welding, soldering or using an electrically conductive adhesive. Accordingly, the formation of the material-to-material bond may cause melting of the surface of electrical connecting elements 31, 32.

In a next step, according to FIG. 2*c*, the region of the cable that is partially stripped and provided with electrical device 3 is covered with a protective layer 5. This may be accomplished, for example, by overmolding the respective location of the cable or, more precisely, of conductors 1, 2 and electrical device 3, with plastic. Protective layer 5 serves, on the one hand, to protect conductors 1, 2 and electrical device 3 from environmental influences. On the other hand, it may also provide vibration damping. Moreover, improved support and constraint can thereby be achieved for a cable shield encompassing conductors 1, 2 and electrical device 3.

Figure 2D:
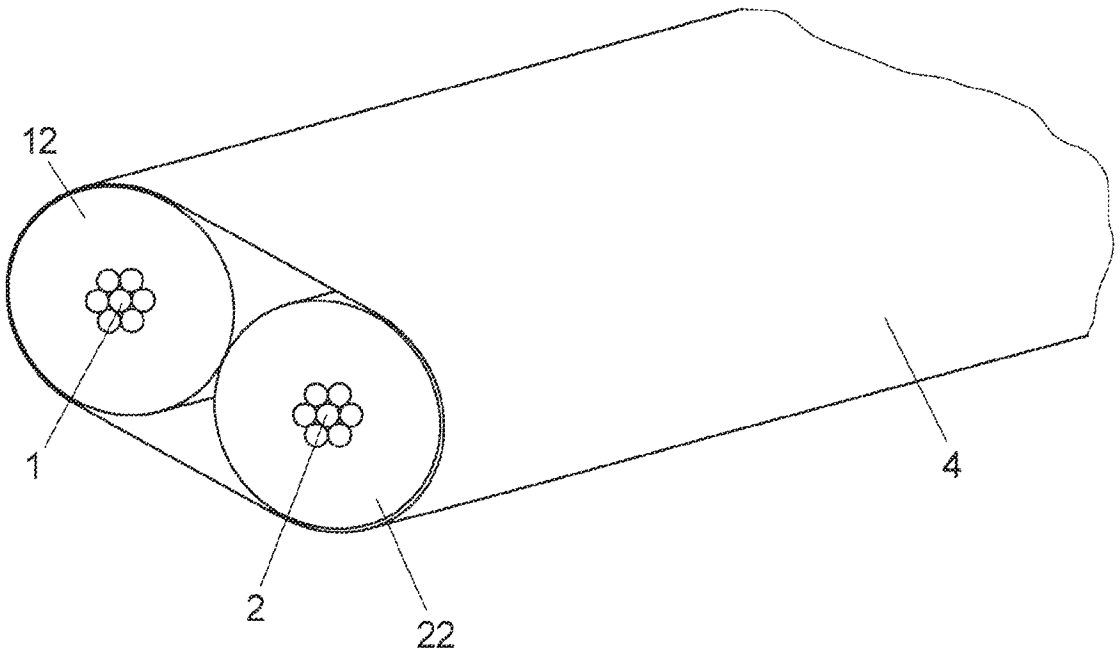
FIG. 2*d* shows a third step during the manufacture of the cable, based on FIG. 2*a*.

According to FIG. 2*d*, conductors 1, 2, including their insulations 12, 22, as well as the region that is partially stripped and provided with electrical device 3 are surrounded by a cable shield 4. This cable shield may be in the form of a (metallic) foil, in particular an aluminum foil. In order to form a cable shield 4, the foil is wrapped around conductors 1, 2, including the associated insulations 12, 22. Cable shield 4 serves to provide electrical shielding, particularly shielding of the cable over its entire length along longitudinal cable direction L.

This assembly may, in turn, be surrounded by an outer cable jacket 6, as explained with reference to FIGS. 1*a* through 1*d*. Cable 6 may be applied around the cable shield 4 extending along longitudinal cable direction L, for example, by means of an extruder; i.e., using an extrusion process.

In a refinement, it is also possible to place a plurality of electrical devices 3 on the cable along longitudinal cable direction L in spaced-apart relationship to one another. This may be done, firstly, for the purpose of being able to use multiple electrical devices in a particular cable application. Secondly, provision may also be made to divide the cable into a plurality of separate cables (cable sections) during cable assembly, whereupon each of the separate cables has one of the electrical devices of the original (endless) cable.

In the exemplary embodiment presented here, the cable is, by way of example, provided with an electrical device 3 in the form of an RFID element. Such a cable is uniquely identifiable by a suitable reader device or reader electronics. This allows cable to be identified, for example, during installation in a motor vehicle, thereby enabling reliable quality assurance in the manufacturing process.

Frequently, such a cable is connected to a control unit of a motor vehicle. During operation of the respective motor vehicle, data injected into conductors 1, 2, for example, from the control unit, can be transmitted to electrical device 3 through its points of contact with conductors 1, 2 and stored therein. Such data may include fault information or operating time information. This data can be read out by an external device, for example, in the event of a repair.

Alternatively or additionally, reader electronics may be permanently installed near such a cable or near a wiring harness including a plurality of such cables. This makes it possible, for example, to query at certain intervals whether indeed original cables are installed and/or whether fault information is present. The purpose of this is to provide protection against tampering with the respective wiring harness. This feature may be of special advantage, particularly in safety-critical applications, in particular after repairs.

If a wiring harness is composed of a plurality of cables having electrical devices 3 in the form of RFID elements, the entire wiring harness can be effectively checked by querying a checksum composed of all ID numbers of the individual cables.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A shielded electrical cable comprising:

at least two spaced-apart conductors extending side-by-side along a longitudinal cable direction;

an insulation by which the conductors are electrically insulated from each other;

a cable shield which, together with the conductors, extends along the longitudinal cable direction and annularly surrounds the conductors, as seen in cross section; and at least one electrical device disposed between the conductors and the cable shield, the at least one electrical device being surrounded by the cable shield and disposed on the conductors such that the at least one electrical device is in electrical contact with each of the conductors, wherein the at least one electrical device is disposed in a cable region which is free of electrical connector elements configured for making electrical contact with a mating connector, the cable shield extending across the at least one electrical device in the longitudinal direction of the cable.

2. The cable as recited in claim 1, wherein the at least one electrical device has a carrier body which rests against each of the conductors via electrical connecting elements formed on the carrier body.

3. The cable as recited in claim 2, wherein the electrical connecting elements formed on the carrier body are in the form of rigid electrical connection points via which the carrier body rests against the conductors in a fixed position relative thereto.

4. The cable as recited in claim 2, wherein the carrier body is in the form of a circuit board.

5. The cable as recited in claim 2, wherein the at least one electrical device is fixedly attached to the conductors via the electrical connecting elements by a material-to-material bond.

6. The cable as recited in claim 1, wherein the at least one electrical device is fixedly attached to the conductors by a material-to-material bond.

7. The cable as recited in claim 1, wherein at least one of the conductors has a discontinuity at a location where the at least one electrical device is disposed, and wherein the discontinuity is bridged by the at least one electrical device.

8. The cable as recited in claim 1, wherein the insulation of the conductors is partially removed at a location where the electrical device is disposed so as to form a receptacle for the at least one electrical device.

9. The cable as recited in claim 1, wherein, at a location where the at least one electrical device is disposed, the conductors, together with the at least one electrical device, are surrounded by a protective layer which is produced separately from the insulation, the protective layer being surrounded by the cable shield.

10. The cable as recited in claim 1, wherein the cable is attached to at least one connector having at least one of the electrical connector elements configured to make electrical contact with the mating connector, and wherein the at least one electrical device is disposed in the cable outside of a region of the connector.

11. The cable as recited in claim 10, wherein the at least one electrical device is disposed outside of a connector housing of the connector.

12. The cable as recited in claim 1, wherein the at least one electrical device is in the form of a passive electrical device.

13. The cable as recited in claim 1, wherein the at least one electrical device is in the form of an active electrical device.

14. The cable as recited in claim 1, wherein a plurality of electrical devices are disposed in the cable along the longitudinal cable direction in a spaced-apart relationship to one another.

15. A method for manufacturing a shielded electrical cable according to claim 1, the method comprising:

a) at least partially removing the insulation of the conductors in a section of the conductors;

b) placing the at least one electrical device on the conductors in the section of the conductors in which the insulation is at least partially removed such that the at least one electrical device is in electrical contact with each of the conductors, c) surrounding the conductors, the insulation and the at least one electrical device by the cable shield extending along the longitudinal cable direction.

16. The method as recited in claim 15, wherein the cable shield, together with the at least one electrical device surrounded by the cable shield, is surrounded by a cable jacket extending along the longitudinal cable direction.

17. The method as recited in claim 16, wherein the cable jacket is made to surround the cable shield using an extrusion process.

* * * * *